US005371970A

United States Patent [19]

Ganikon

[11] Patent Number: 5,371,970

[45] Date of Patent: Dec. 13, 1994

[54] GARAGE DOOR LOCKING APPARATUS

[76] Inventor: Mark Ganikon, 240 Patrick Dr., El Cajon, Calif. 92019

[21] Appl. No.: 27,648

[22] Filed: Mar. 8, 1993

[51] Int. Cl.[5] ..... E05F 15/00

[52] U.S. Cl. ..... 49/280; 49/199; 160/189; 292/DIG. 36; 292/DIG. 62

[58] Field of Search ..... 49/280, 197, 199; 160/188, 189; 292/DIG. 26, DIG. 36, DIG. 62, 38

[56] References Cited

U.S. PATENT DOCUMENTS

| | | | |
|---|---|---|---|
| 3,708,917 | 1/1973 | Streeter | 49/280 |
| 4,254,582 | 3/1981 | McGee | 49/280 X |
| 4,597,224 | 7/1986 | Tucker | 49/280 X |
| 4,827,667 | 5/1989 | Jarvis | 49/280 |
| 4,884,831 | 12/1989 | Emon | 49/280 X |

*Primary Examiner*—Peter M. Cuomo
*Assistant Examiner*—Jerry Redman
*Attorney, Agent, or Firm*—E. Michael Combs

[57] ABSTRACT

A garage door includes a door connector assembly in operative communication with a garage door carriage track, wherein the connector assembly mounts a plurality of cables, wherein each cable is mounted along the garage door and secured to a respective latch assembly, whereupon lifting of the door removes latch bolts from an underlying garage floor, whereupon closure of the door directs the latch bolts into the garage floor, and the door connector assembly includes biasing spring structure to bias the door into communication with the garage floor to maintain the latch bolt positioning within the floor.

5 Claims, 4 Drawing Sheets

GARAGE DOOR LOCKING APPARATUS

BACKGROUND OF THE INVENTION

1. Field of the Invention

The field of invention relates to garage door apparatus, and more particularly pertains to a new and improved garage door locking apparatus wherein the same is arranged for the latching of a garage door relative to an underlying floor assembly.

2. Description of the Prior Art

Garage door locking structure of various types have been utilized in the prior art and exemplified by the U.S. Pat. Nos. 4,905,542; 4,996,795; 4,655,487; and 4,911.486.

The instant invention attempts to overcome deficiencies of the prior art by employing latch bolts mounted to the garage door to direct the latch bolts into the garage floor when the garage door is directed in a closed position.

SUMMARY OF THE INVENTION

In view of the foregoing disadvantages inherent in the known types of garage door locking apparatus now present in the prior art, the present invention provides a garage door locking apparatus wherein the same is directed to the directing of garage door bolts into an underlying garage floor upon directing the garage door in a closed orientation relative to a garage door opening. As such, the general purpose of the present invention, which will be described subsequently in greater detail, is to provide a new and improved garage door locking apparatus which has all the advantages of the prior art garage door locking apparatus and none of the disadvantages.

To attain this, the present invention provides a garage door including a door connector assembly in operative communication with a garage door carriage track, wherein the connector assembly mounts a plurality of cables, wherein each cable is mounted along the garage door and secured to a respective latch assembly, whereupon lifting of the door removes latch bolts from an underlying garage floor, whereupon closure of the door directs the latch bolts into the garage floor, and the door connector assembly includes biasing spring structure to bias the door into communication with the garage floor to maintain the latch bolt positioning within the floor.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved garage door locking apparatus which has all the advantages of the prior art garage door locking apparatus and none of the disadvantages.

It is another object of the present invention to provide a new and improved garage door locking apparatus which may be easily and efficiently manufactured and marketed.

It is a further object of the present invention to provide a new and improved garage door locking apparatus which is of a durable and reliable construction.

An even further object of the present invention is to provide a new and improved garage door locking apparatus which is susceptible of a low cost of manufacture with regard to both materials and labor, and which accordingly is then susceptible of low prices of sale to the consuming public, thereby making such garage door locking apparatus economically available to the buying public.

Still yet another object of the present invention is to provide a new and improved garage door locking apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
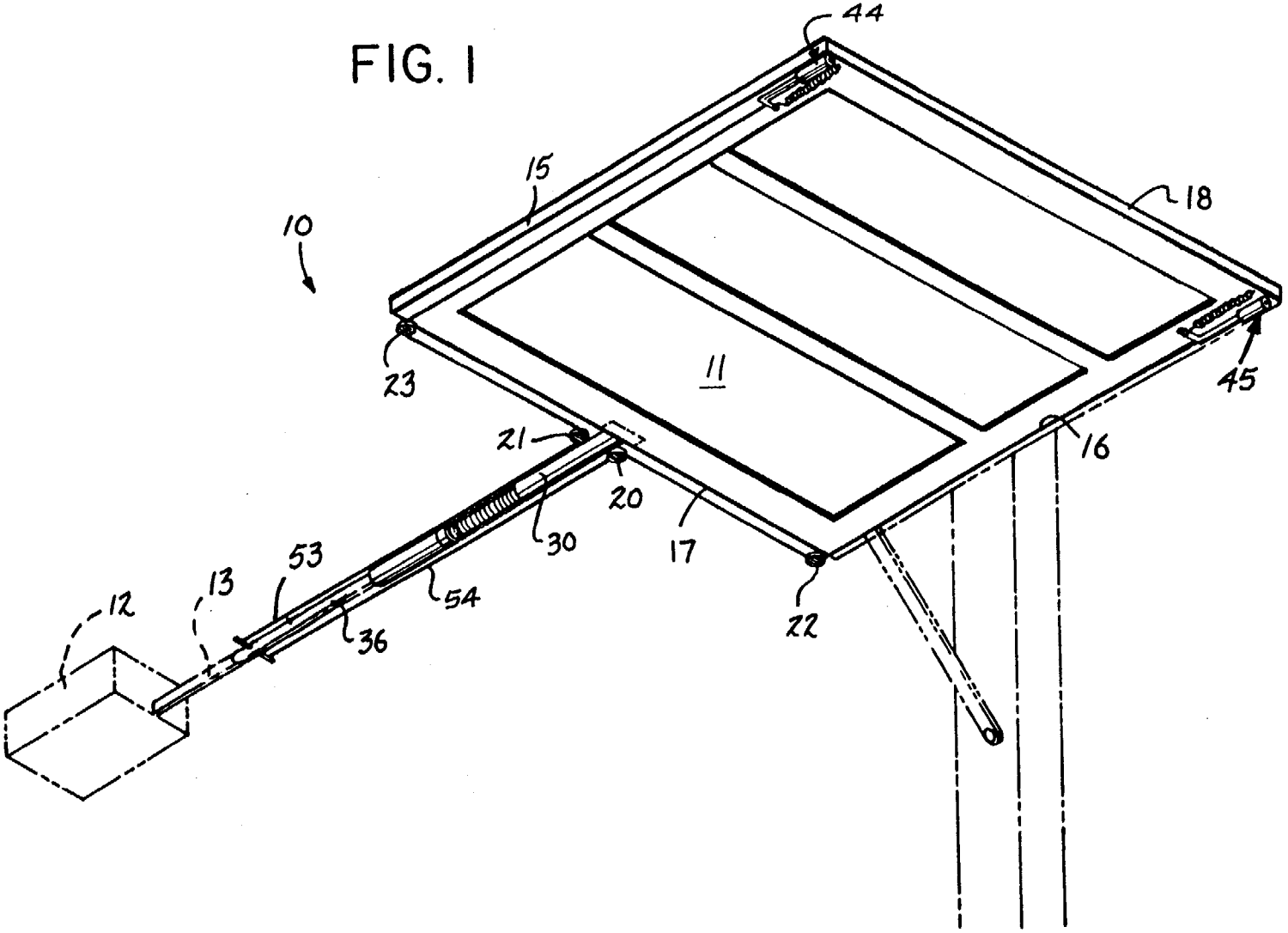
FIG. 1 is an isometric illustration of the invention with the garage door in an opened first position relative to a garage door opening.

With reference now to the drawings, and in particular to FIGS. 1 to 7 thereof, a new and improved garage door locking apparatus embodying the principles and concepts of the present invention and generally designated by the reference numeral 10 will be described.

More specifically, the garage door locking apparatus 10 of the instant invention essentially comprises a garage door 11, having a door first side 15 spaced from a second side 16, a door first end 17 spaced from a door second end 18. A motorized opener 12 is provided mounted in a spaced relationship relative to the door 11, with the opener 12 having a track 13 extending from the garage door opener to an opposing wall structure in a conventional manner. The track includes a track carriage 14 that is reciprocatably mounted about the track 13 and driven by either a drive chain or a gear structure, in a manner known in the prior art. The track carriage 14 includes a door connector assembly 19 (see FIGS. 5–7), with the door connector assembly operative through respective first and second pulleys 20 and 21 mounted to the garage door on opposed sides of the connector assembly adjacent the first end 17. Third and fourth pulleys 22 and 23 respectively are mounted to the door adjacent the first end 17 and the respective first and second sides 15 and 16. Respective first and second cables 53 and 54 mounted to the door connector assembly 19 are operative through the pulley structure, in a manner as indicated in FIGS. 1 and 2, and in operative communication to respective first and second latch assemblies 44 and 45 mounted to the respective door 11 adjacent the first and second sides 15 and 16 and the second end 18.

Figure 5:
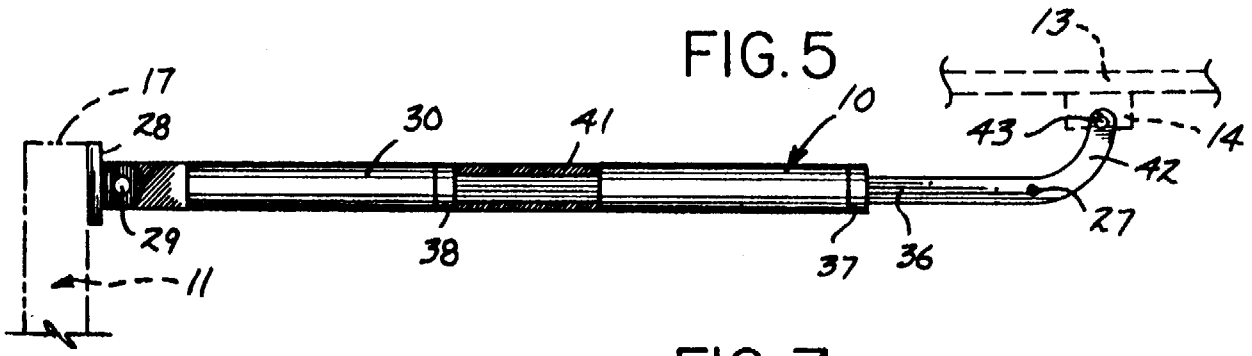
FIG. 5 is an orthographic side view of the door connector assembly of the invention.
Figure 7:
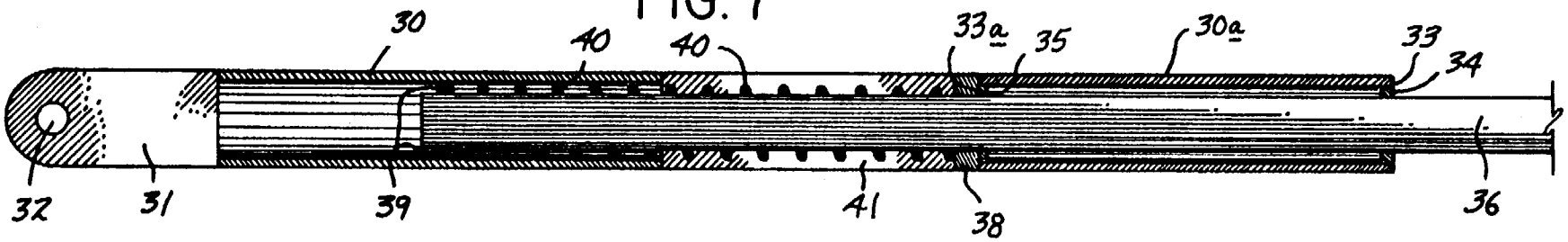
FIG. 7 is an enlarged orthographic view of the connector assembly indicating the orientation of the spring member relative to the outer tube structure.
Figure 6:
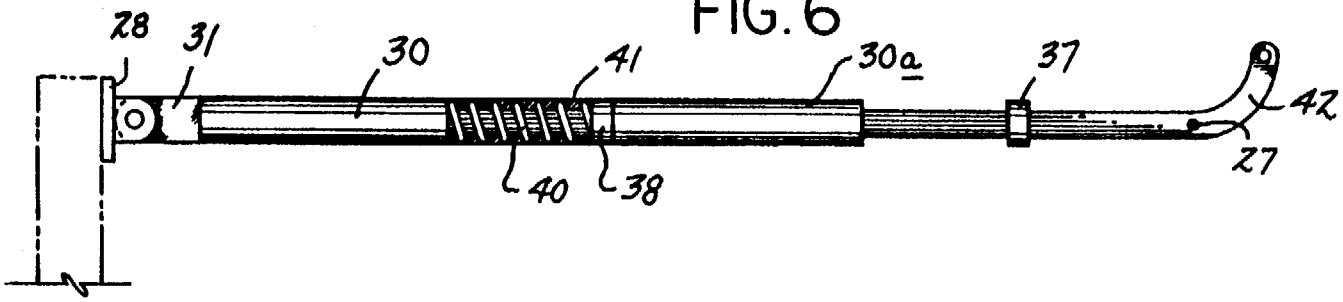
FIG. 6 is an orthographic view of the connector assembly indicating the positioning of the spring member.

The door connector assembly 19 includes door mounting boss 28 fixedly secured to the door 11, with the door mounting boss 28 having a door mounting boss axle 29, while a first door tube 30 includes a mounting flange 31 coaxially aligned relative to the door tube 30, having a mounting flange aperture 32 receiving the axle 29 pivotally mounting the first door tube 30 relative to the door mounting boss 28. A second door tube 30*a* is arranged in a spaced coaxially aligned relationship relative to the first door tube 30 and secured integrally thereto by a connecting web 41. The second door tube 30*a* includes an entrance end 33, with respective first alignment ring 34 mounted to the entrance end 33, and a second alignment ring 35 mounted to an exit end 33*a* of the second door tube 30*a*. A slide rod 36 accordingly is slidably directed in a coaxially aligned relationship through the first and second alignment rings 34 and 35, with the slide rod 36 slidably directed into the first door tube 30 in a coaxially aligned relationship. A first abutment 37 is mounted to the slide rod 36, with the first abutment 37 arranged in abutment with the second door tube entrance end 33 in a first position, and the first abutment 37 spaced from the entrance end 33 in a second position, as indicated in FIG. 6 for example. A second abutment 38 is mounted to the slide rod 36 intermediate the first and second door tubes 30 and 30*a*, with the second abutment 38 arranged in abutment with the first door tube in the first position and in abutment with the second door tube exit end 33 in the second position, as indicated in FIGS. 5 and 6 respectively. A door tube floor ring 39 is fixedly mounted within the first door tube adjacent the mounting flange 31 to slidably receive the slide rod 36 therethrough, and additionally provide abutment for a door spring 40 that extends from the door tube floor ring 39 to the slide rod second abutment 30*a*. In this manner, when the garage door 11 is in a closed first position, as illustrated in FIG. 1, and the door connector assembly 19 is in the first position with the first abutment in engagement with the second door tube entrance end 33 the door spring 40 biased against the door tube floor ring 39 biases the first and second door tubes to bias the garage door in the first position exerting spring pressure upon the garage door 11. As illustrated in FIG. 5 for example, a carriage axle 43 is directed through a slide rod angulated end portion 42 extending laterally from the slide rod pivotally mounting the slide rod angulated end portion 42 to the track carriage 14.

Figure 2:
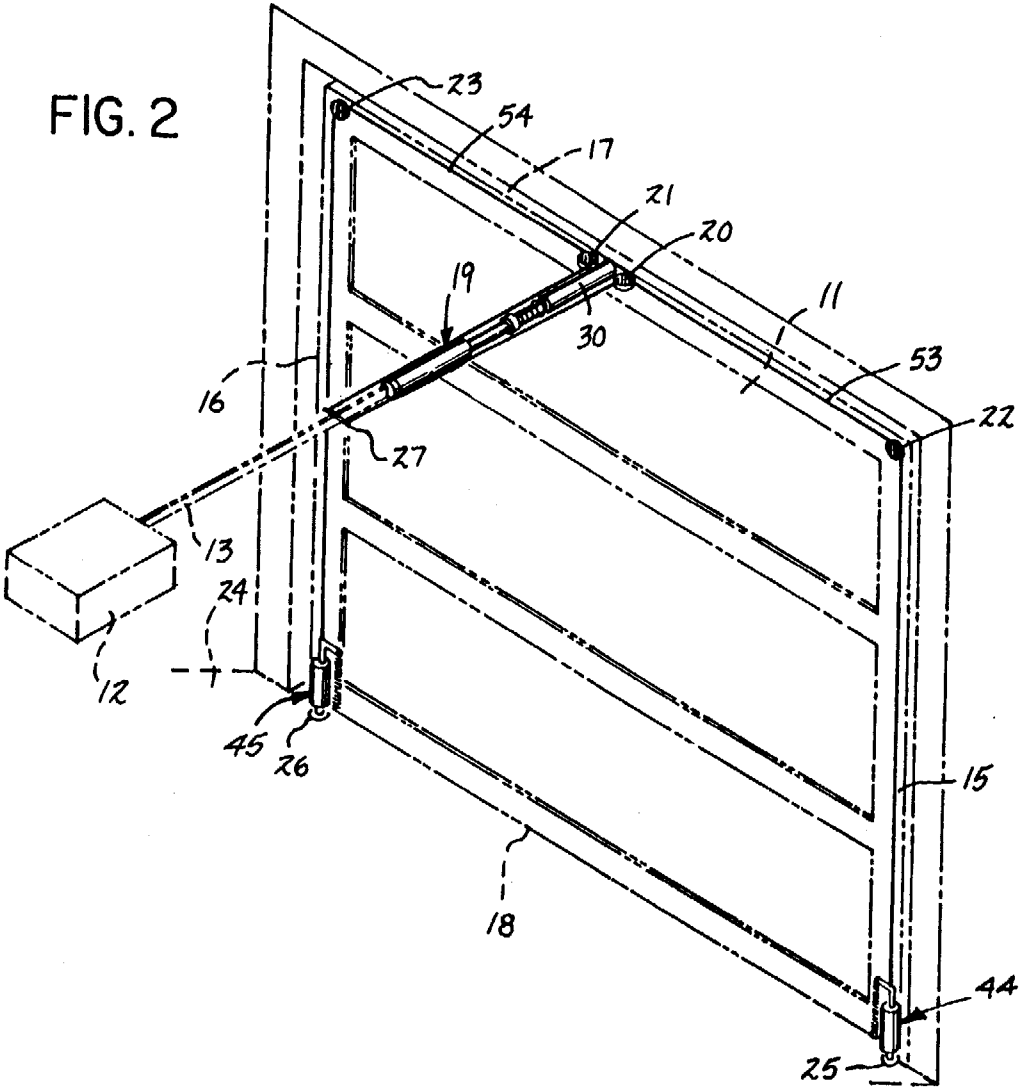
FIG. 2 is an isometric illustration of the invention with the garage door in a closed second position.

The cross pin 27 mounted to the slide rod 36 adjacent the slide rod angulated end portion 42 extends orthogonally through the slide rod 36, in a manner as illustrated in the FIGS. 1 and 2.

As noted above, the first cable 53 extends from the cross pin 27 through the first pulley 20, the third pulley 22, and to the first latch assembly 44. The second cable 54 extends from the cross pin 27 slidably along the respective second and fourth pulleys 21 and 23 to the second latch assembly 45. The first and second latch assemblies 44 and 45 each include an individual latch rod 48 (see FIGS. 3 and 4), with the first and second latch rod of the first and second latch assemblies 44 and 45 received within respective garage floor first and second latch cavities 25 and 26 to direct the respective latch rods into the respective latch cavities of the latch floor 24.

Figure 3:
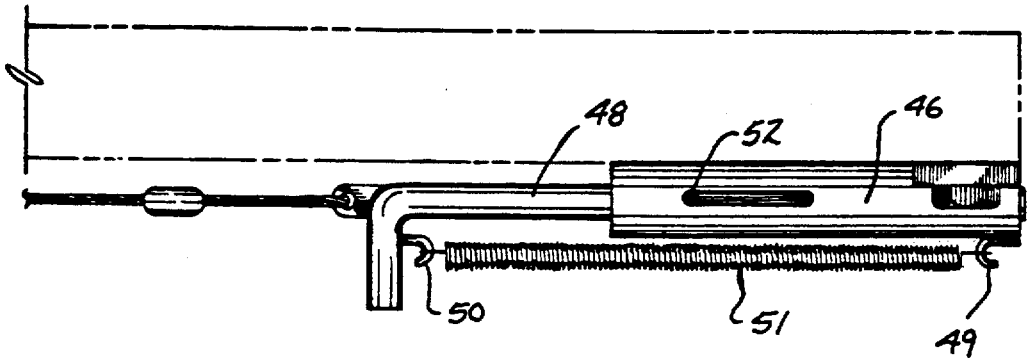
FIG. 3 is an enlarged orthographic view of a latch cylinder organization employed by the invention.
Figure 4:
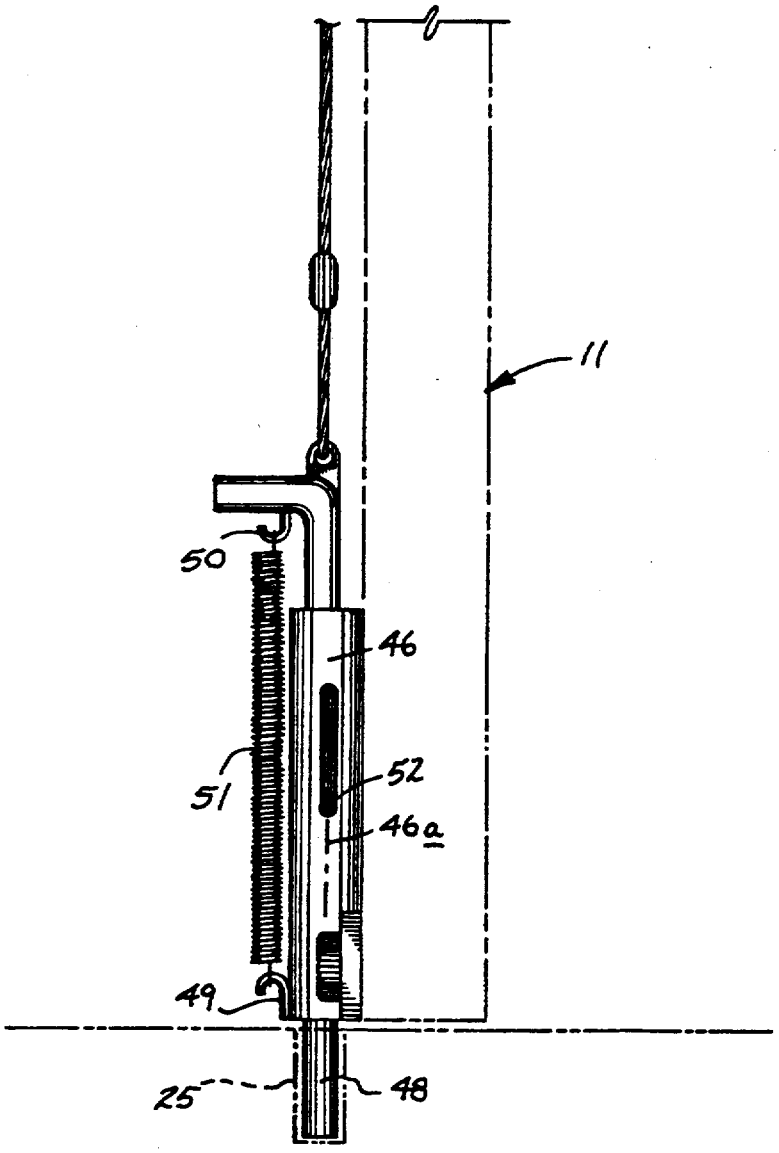
FIG. 4 is an orthographic view of the invention with the latch assembly and a latch bolt directed into an underlying garage floor.

With reference to the FIGS. 3 and 4, and as the first and second latch assemblies 44 and 45 are of identical construction, for purposes of illustration, only one such latch assembly is to be described and illustrated but it is to be understood that the structure is representative of each latch assembly 44 and 45 in use. A latch cylinder 46 is provided relative to each latch assembly, having a latch cylinder slot 47 directed through the latch cylinder wall parallel to the axis 46*a* of the associated latch cylinder 46, with the latch rod 48 slidably received through the latch cylinder 46. A first latch anchor 49 is mounted to the latch cylinder 46 at a forward end of the latch cylinder, with the latch rod 48 directed into the latch cylinder through a second end of the latch cylinder, with a second spring anchor 50 mounted to the latch rod 48. A latch spring 51 indicated between the first and second spring anchors 49 and 50 bias the latch rod 48 to project through the first end of the latch cylinder 46 to be received in an associated latch cavity. A latch rod guide lug 52 mounted to the latch rod is slidably received within the slot 47 to guide the latch rod within the latch cylinder 46. In this manner, when the garage door is directed to the second position, as indicated in FIG. 2, the associated cable structures 53 and 54 relative to the respective first and second latch assemblies 44 and 45 withdraws the respective latch rod 48 to extend the respective latch rod relative to the respective latch cylinder of the latch assemblies. It should be further noted that, as illustrated, the latch rods are directed into the floor of the garage, the latch assemblies may be rotated ninety degrees, with associated respective guide structure to direct the latch rods into the door frame portions of the associated garage door.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A garage door locking apparatus directed to secure a garage door within a garage door opening from a first position spacing the garage door from the garage door opening to a second position directing the garage door within the garage door opening, with a motorized opener having a track, and the track including a track carriage, and the garage door including a first side spaced from a second side and a first end spaced from a second end, and wherein the apparatus comprises, a door connector assembly directed between the track carriage and the garage door, and wherein a first pulley and a second pulley are mounted to opposed sides of the door connector assembly, and a third pulley and a fourth pulley are mounted to respective door first and second sides in adjacency to the first end, and a first latch assembly is mounted to the door adjacent the first side and the second end, and a second latch assembly is mounted to the door adjacent the door second side and the door second end, and a first cable directed from the door connector assembly along the first pulley and the third pulley to the first latch assembly, and a second cable directed from the door connector assembly along the second pulley and the fourth pulley to the second latch assembly, whereupon displacement of the track carriage from the second position separates the first latch assembly and the second latch assembly from an engaged relationship to a door floor adjacent the garage door opening, and the door connector assembly includes a door mounting boss fixedly mounted to the door between the first pulley and the second pulley, and the door mounting boss having a boss axle, and a first door tube and a second door tube spaced from the first door tube in a coaxially aligned relationship, and a connecting web connecting the first door tube to the second door tube, and the first door tube including a mounting flange coaxially aligned with the first door tube and the second door tube, and the mounting flange including a flange aperture, and the flange aperture mounted to the door mounting boss and the boss axle, and the second door tube having an entrance end and an exit end, with the exit end positioned intermediate the first door tube and the second door tube, and a first alignment ring mounted to the entrance end and a second alignment ring mounted to the exit end, and a slide rod slidably directed through the first alignment ring and the second alignment ring, and the slide rod coaxially aligned with the first door tube and the second door tube received within the second door tube, and the slide rod having a first abutment in engagement with the entrance end from the first position, and a second abutment positioned in engagement with the second door tube in the first position, and the second abutment in contiguous communication with the exit end of the second door tube in the second position.

2. An apparatus as set forth in claim 1 wherein the first abutment displaced from the entrance end in the second position, and the first door tube having a door tube flooring fixedly mounted within the first door tube in adjacency to the mounting flange, and a door spring interposed between the door tube floor ring and the second abutment to bias the first door tube and the second door tube and the garage door in engagement with the garage floor in the first position.

3. An apparatus as set forth in claim 2 wherein the slide rod includes a slide rod angulated end portion extending laterally from the slide rod exteriorly of the second door tube and the first door tube, and the slide rod angulated end portion including a carriage axle directed orthogonally therethrough, the carriage axle arranged parallel relative to the boss axle, and the carriage axle pivotally mounted to the track carriage.

4. An apparatus as set forth in claim 3 with a cross pin fixedly and orthogonally directed through the slide rod between the second door tube and the angulated end portion, and the first cable mounted to the cross pin on a first side of the slide rod, and a second cable mounted to the cross pin on a second side of the slide rod.

5. An apparatus as set forth in claim 4 wherein the first latch assembly and the second latch assembly each include a latch cylinder, each latch cylinder including a latch cylinder slot, and the latch cylinder having a latch cylinder axis and the cylinder slot arranged parallel rio the axis, and a latch rod slidably and coaxially directed through the latch cylinder, and the latch rod having a guide lug, and the guide lug received within the slot, and a first spring anchor mounted to the latch cylinder, and a second spring anchor mounted to the latch rod, with a latch spring extending between the first spring anchor and the second spring anchor to bias the latch rod in a projecting relationship through the latch cylinder.

* * * * *